United States Patent [19]

Wolf, Jr.

[11] Patent Number: 4,633,800

[45] Date of Patent: Jan. 6, 1987

[54] SAILBOAT TILLER

[76] Inventor: F. Andrew Wolf, Jr., 230 N. Washington Dr., Sarasota, Fla. 33577

[21] Appl. No.: 702,937

[22] Filed: Feb. 19, 1985

[51] Int. Cl.[4] ..... B63H 25/02

[52] U.S. Cl. ..... 114/144 R; 114/162; 403/327

[58] Field of Search ..... 114/144 R, 162, 163, 114/146, 153, 39; 16/110 R, 111 R, 114 R; 403/327, 328

[56] References Cited

U.S. PATENT DOCUMENTS

| | | | |
|---|---|---|---|
| 319,665 | 6/1885 | Barney | 114/144 R |
| 594,068 | 11/1897 | Dobson | 114/162 |
| 1,269,413 | 6/1918 | Finnigan | 403/328 X |
| 1,850,669 | 3/1932 | Harvey | 114/162 |
| 2,826,088 | 3/1958 | Wittick | 74/479 |
| 3,155,414 | 11/1964 | Bales | 16/114 R X |
| 3,274,849 | 9/1966 | Hanson | 74/480 |
| 3,665,785 | 5/1972 | Moal | 74/543 |
| 3,810,440 | 5/1974 | Johnson, Jr. | 114/162 |
| 4,228,756 | 10/1980 | Storer, Jr. | 114/163 X |
| 4,262,619 | 4/1981 | Hine | 114/144 R |
| 4,317,387 | 3/1982 | Myers et al. | 74/493 |
| 4,553,496 | 11/1985 | Foresman | 114/144 R |

FOREIGN PATENT DOCUMENTS

| | | | |
|---|---|---|---|
| 47360 | 1/1909 | Switzerland | 16/114 R |

*Primary Examiner*—Sherman D. Basinger

*Attorney, Agent, or Firm*—Charles J. Prescott; Raymond H. Quist

[57] ABSTRACT

A catamaran tiller having a grip is provided to permit tension to be applied to the tiller more easily. In one embodiment the grip extends laterally from a sleeve which fits over the tiller rod and is secured thereto at a desired location. Provision is made to have the grip rotatably mounted on the sleeve or for the sleeved to be secured with the grips in alternative positions. A circular grip is also disclosed.

6 Claims, 9 Drawing Figures

SAILBOAT TILLER

BACKGROUND OF THE INVENTION

This invention relates generally to sailboat tillers and more particularly to a sailboat tiller having a grip to relieve the stress in holding it.

Dual hull vessels such as catamarans have a rudder assembly for each pontoon (see FIG. 1) which includes the rudder portion which can be moved to extend into the water. A lever is attached to each rudder for moving it and holding it in a desired position. A link connects the two levers at their ends, and a tiller is attached to the center of the link. Through this arrangement, both rudders are simultaneously controlled by applying tension to the tiller.

The need for exerting a substantial pull on the tiller for extended periods of time is particularly difficult with the tiller of the catamaran because it is a slim (about one half inch diameter) rod. Muscle groups of the hand, arm and shoulder must be used to maintain a grip with one or both hands with sufficient tension and pressure to resist the pull of the rudder/tiller assembly. This becomes fatiguing and even painful after prolonged periods; however, failure to maintain the needed tension may result in loss of control with disasterous results.

It is therefore an object of this invention to provide a tiller having a grip for a multihulled vessel such as a catamaran or a grip which may be attached to the existing tiller on such a vessel.

SUMMARY OF THE INVENTION

A tiller having a laterally extending grip is provided. Provision is made to locate the grip at a desired axial position on the tiller rod. The circumferential position of the grip is adjustable in some embodiments.

DETAILED DESCRIPTION OF THE INVENTION

Figure 1:
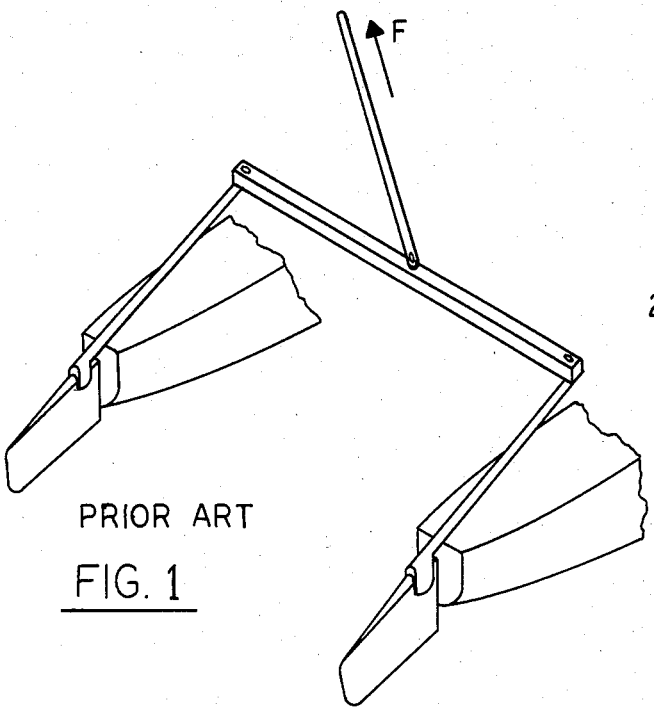
PRIOR ART FIG. 1
FIG. 1 shows schematically a typical prior art rudder assembly.
Figure 2:
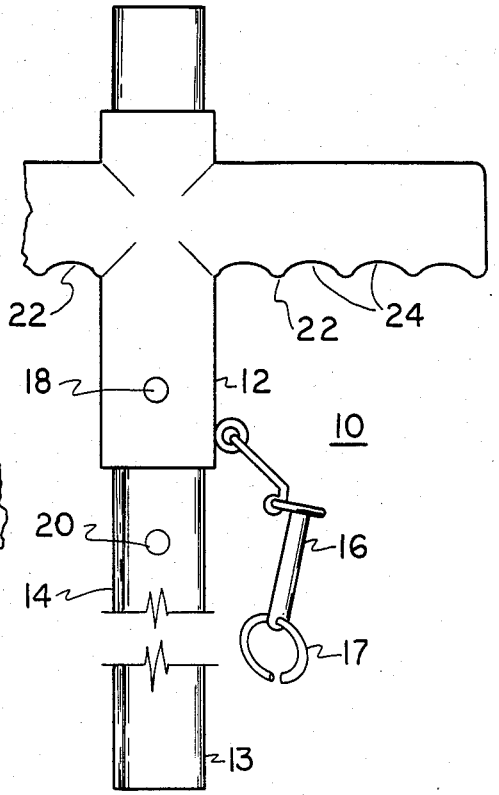
FIG. 2 is a plan view of one embodiment of a sailboat tiller in accordance with the invention.

Referring to FIG. 2, sailboat tiller 10 has sleeve 12 which fits over tiller rod 14. The distal end 13 of tiller rod 14 is pivotally connected to the link connecting the levers attached to the rudders of the catamaran in lieu of the tiller found in the prior art arrangements. Sleeve 12 may be secured on tiller rod 14 in a desired location by positioning captive pin 16 through aperture 18 in sleeve 12 and a corresponding aperture 20 in tiller rod 14. Aperture 20 may extend through tiller rod 14 from top to bottom as in FIG. 2, although apertures which extend through tiller rod 14 from one side to the other and apertures which pass only part way through tiller rod 14 are also contemplated. Pin 16 can be secured in position using split ring 17 or the like. The use of captive pin 16 with suitable apertures to secure sleeve 12 in a desired location on tiller rod 14 is by way of example and other securing means may alternatively be used. Laterally extending from opposite sides of sleeve 12 are grips 22. Grips 22 may be provided with grooves 24 for fingers by using rubber grips available for bicycle handle bars and other purposes.

Figure 3:
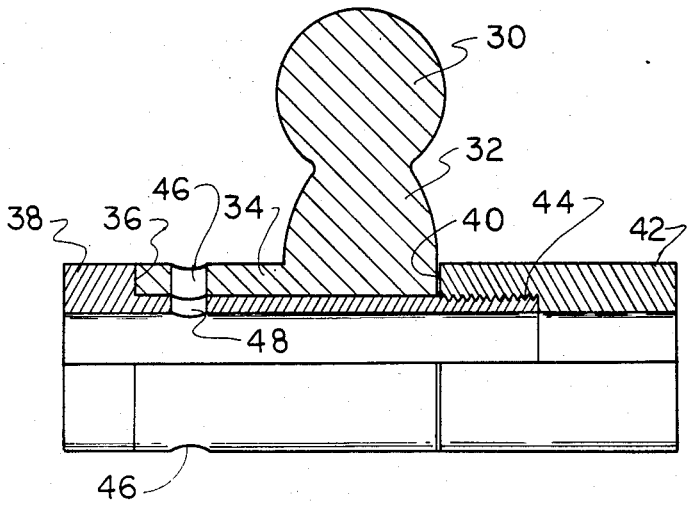
FIG. 3 is a lateral elevation in half cross-section of a second embodiment of the invention.

In some cases it may be desired to hold grips 22 in a position other than that afforded by the embodiment in FIG. 2 used in conjunction with top-to-bottom apertures in tiller rod 14. Referring to FIG. 3, grips 30 are mounted on pedestal 32. Pedestal 32 is joined to (or made a part of) collar 34 which is rotatably mounted between shoulder 36 of sleeve portion 38, and shoulder 40 of sleeve portion 42. Sleeve portions 38 and 42 are joined by threads 44. The embodiment of FIG. 3 is provided to illustrate one way of providing a rotational mounting for grips 30 although other methods may be used. Apertures 46 in collar 34 and apertures 48 in sleeve portion 38 permit grips 30 to be locked so as not to rotate by using a pin as in FIG. 2.

It will be recognized that the coxswain does not stay in one position, but acts as ballast along with other crew members, moving to adjust the trim of the boat. For this reason, it is preferable to be able to change the position of grips 30, not only rotationally, as described with respect to FIG. 3, but also axially along tiller rod 14 as described with respect to FIG. 2. Moreover, being able to change this position rapidly can be critical.

Figure 4:
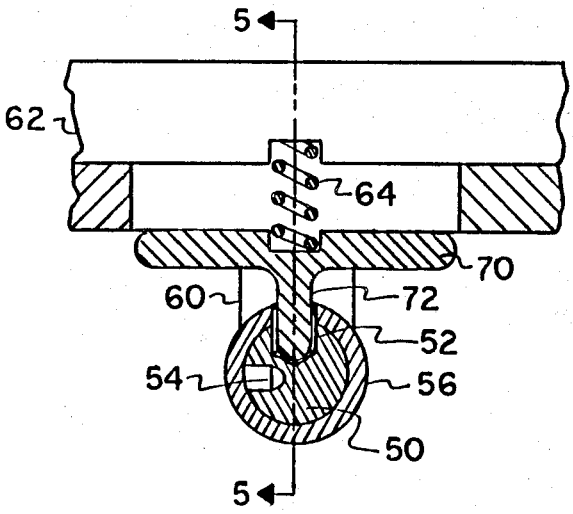
FIG. 4 is an elevation from the distal end of the tiller partially in cross-section.
Figure 5:
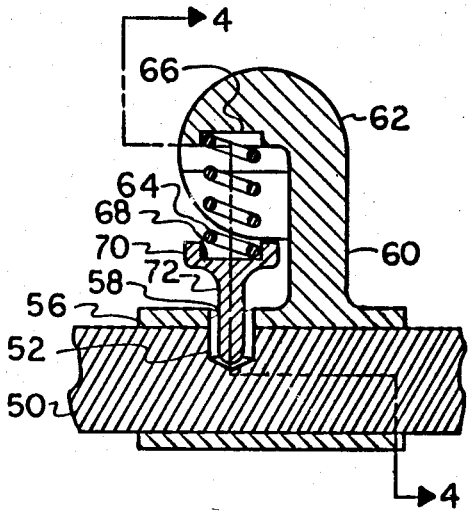
FIG. 5 is a lateral elevation of FIG. 4 in cross-section.

Referring next to FIGS. 4 and 5, tiller rod 50 has aperture 52 which extends only part way through tiller rod 50 and is one of a plurality of such apertures. Aperture 54, it will be noted, is located ninety degrees circumferentially from aperture 52 and axially displaced therefrom (as can be seen from the sectioning line in FIG. 5). Sleeve 56 has a single aperture 58 which, in accordance with the description already provided, may be positioned to coincide with any aperture in tiller rod 50. Sleeve 56 has pedestal 60 thereon which supports grips 62. FIG. 4 is an elevation viewed from the distal end of tiller rod 50, and it shows that pedestal 60 is shaped to provide space for spring 64 on the distal side of pedestal 60. Spring 64 is supported at the top in socket 66 and at the bottom in socket 68. Socket 68 is formed in the top of pin retracting handle 70 so that pin 72 is biased by spring 64 into sleeve aperture 58 and tiller rod aperture 52. When pin retracting handle 70 is pulled up, compressing spring 64, sleeve 56 can be moved to another position with aperture 54 over another tiller rod aperture. Releasing pin retracting handle 70 then locks grips 62 in the new position. Pin retracting handle 70 has been located so that it may be retracted without removing one's hands from grips 62.

Figure 6:
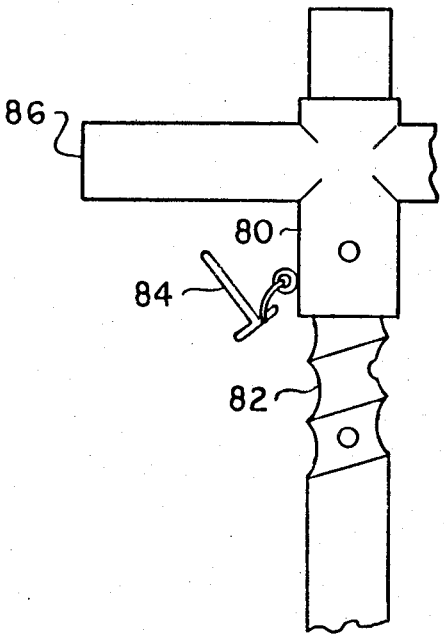
FIG. 6 is a plan view of another embodiment of the invention.

Referring next to FIG. 6 sleeve 80 is shown with tiller rod 82 with both having complementary threading. The threaded arrangement allows maintaining tension on tiller rod 82 through sleeve 80 even while pin 84 is removed for relocation of grips 86 to a more comfortable location.

Figure 7:
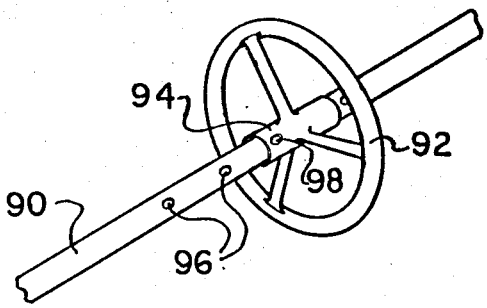
FIG. 7 is an isometric of another embodiment of the invention.

Turning to FIG. 7, tiller rod 90 is shown having circular grip 92 secured to sleeve 94 positioned thereon. As previously described, a plurality of apertures 96 are located along tiller rod 90 so that sleeve 94 may be secured at a desired location using pin 98. Circular grip 92 permits positioning of the hands at any desired circumferential position without the need of using an aperture on the side of tiller rod 90 as was described with aperture 54 of FIG. 4.

Figure 8A:
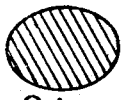
FIG. 8 is a cross-section of two alternate tiller rod cross-sections A and B.
Figure 8B:
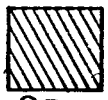

In FIG. 8, A and B represent two other cross-sections which might be chosen for the tiller rod. It is evident that other cross-section configurations might also be used.

It will be evident that an existing tiller may be modified to form the sailboat tiller of this invention, for example by providing appropriate apertures to receive a securing pin. It should also be recognized that the tiller of this invention may also be used as a hiking stick for a single hull vessel.

Although several embodiments of a sailboat tiller handle have been illustrated and described it will be evident that changes and modifications can be made without departing from the spirit of the invention and the scope of the appended claims.

I claim:

1. A sailboat tiller comprising:

an axially extending tiller rod having a plurality of pin receiving apertures;

a sleeve for positioning around said tiller rod having a pin receiving aperture which may be aligned with any one of said apertures in said tiller rod;

a grip secured to said sleeve;

a spring;

a pin retracting handle having a socket to receive one end of said spring;

said grip being mounted on a pedestal secured to said sleeve;

said grip and said pedestal being formed to receive the other end of said spring; and said pin retracting handle having a pin to be retractably positioned in said pin receiving aperture in said sleeve and any pin receiving aperture in said tiller rod.

2. A sailboat tiller comprising:

an axially extending tiller rod having a plurality of pin receiving apertures;

a sleeve for positioning around said tiller rod having a pin receiving aperture which may be aligned with any one of said apertures in said tiller rod;

pin means for positioning through said pin receiving aperture in said sleeve and into a selected aperture in said tiller rod;

grip means secured to said sleeve;

said grip means having a grip extending laterally from each side of said sleeve; and the longitudinal axis of said grips intersecting the longitudinal axis of said tiller rod.

3. A sailboat tiller in accordance with claim 2 wherein:

said tiller rod and said sleeve have complementary screw threads.

4. A sailboat tiller in accordance with claim 2 wherein:

said pin receiving apertures are axially spaced on said rod.

5. A sailboat tiller in accordance with claim 2 wherein:

said pin receiving apertures are axially and circumferentially spaced.

6. A sailboat tiller comprising:

an axially extending tiller rod having a longitudinal axis and a plurality of pin receiving apertures;

said apertures being circumferentially and axially spaced on said tiller rod;

a sleeve for positioning around said tiller rod having a pin receiving aperture which may be aligned with any one of said apertures in said tiller rod;

pin means for positioning through said pin receiving aperture in said sleeve and into a selected aperture in said tiller rod;

grip means secured to said sleeve for rotation with respect to said sleeve about said longitudinal axis of said tiller rod; and said grip means including a pedestal radially extending from said sleeve having a grip extending laterally from each side of said pedestal.

* * * * *